United States Patent [19]

Narasimhan

[11] 4,332,848

[45] Jun. 1, 1982

[54] STRUCTURALLY DEFINED GLASSY METAL STRIPS

[75] Inventor: Mandayam C. Narasimhan, Seekonk, Mass.

[73] Assignee: Allied Corporation, Morris Township, Morris County, N.J.

[21] Appl. No.: 126,249

[22] Filed: Mar. 3, 1980

Related U.S. Application Data

[62] Division of Ser. No. 20,907, Mar. 16, 1979, Pat. No. 4,212,343.

[51] Int. Cl.[3] ..... B32B 3/28; B32B 3/30

[52] U.S. Cl. ..... 428/174; 428/156; 428/179; 428/182; 428/220; 428/457; 428/600; 428/603; 428/687

[58] Field of Search ..... 428/141, 174, 179, 180, 428/457, 156, 600, 220, 687, 182, 603, 604; 75/134 R, 135; 164/64, 66, 87

[56] References Cited

U.S. PATENT DOCUMENTS 3,964,963 6/1976 Anderson ..... 164/87

4,155,397 5/1979 Honsinger et al. ..... 164/87

*Primary Examiner*—Paul J. Thibodeau

*Attorney, Agent, or Firm*—Gerhard H. Fuchs; Ernest D. Buff

[57] ABSTRACT

Structurally defined continuous metal strips are formed by forcing molten metal onto the surface of a moving chill body under pressure through a slotted nozzle located in close proximity to the surface of the chill body. The surface of the chill body (chill surface) whereon casting of the strips takes place has a contoured surface, i.e. it is provided with structurally defined protruberances and/or indentations, which are faithfully replicated by the formed strip, the thickness of the strip being substantially uniform throughout, regardless of whether it replicates a level area of the chill surface or a raised or indented area.

5 Claims, 10 Drawing Figures

FIG. 1
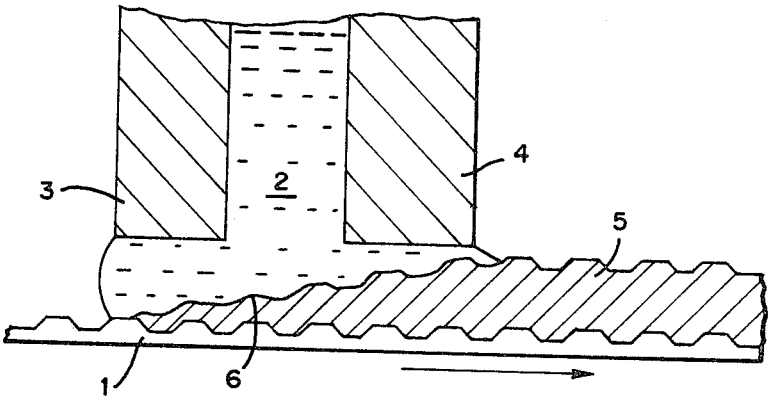
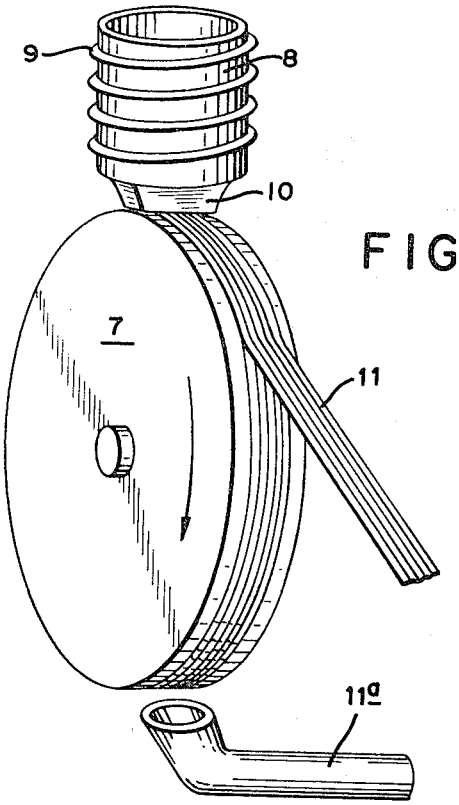
FIG. 2

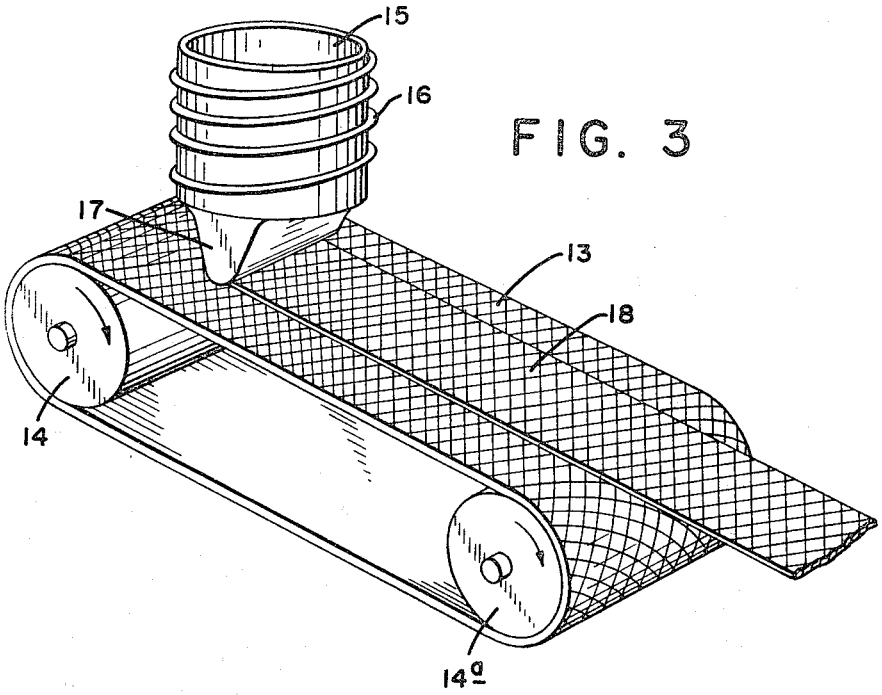
FIG. 3
FIG. 4
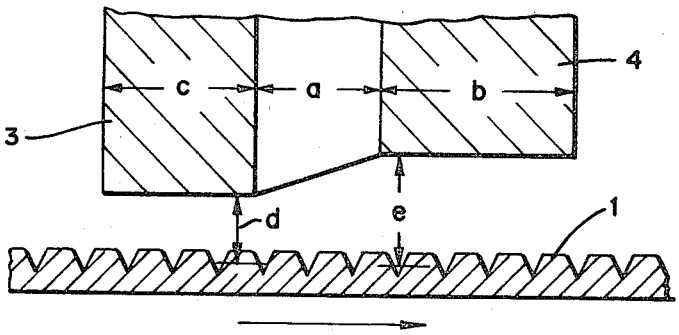

STRUCTURALLY DEFINED GLASSY METAL STRIPS

This is a divisional of application Ser. No. 020,907, filed Mar. 6, 1979, now U.S. Pat. No. 4,212,343.

BACKGROUND OF THE INVENTION

This invention relates to a method and apparatus for making structurally defined continuous metal strips, particularly such strips having a glassy (amorphous) molecular structure, by depositing molten metal onto the contoured, moving surface of a chill body by forcing the metal through a slotted nozzle located in close proximity to the surface of the chill body. The molten metal is instantly quenched into a strip which faithfully replicates the contours of the chill body surface.

For purposes of the present invention, a strip is a slender body whose transverse dimensions are much less than its length, including ribbons and sheets, of regular or irregular cross-section.

The process and apparatus of the present invention are similar to those disclosed in my U.S. Pat. No. 4,142,571. These, however, employ a chill body having an essentially flat chill surface, which consequently produces an essentially flat strip product. Pertinent portions of the disclosure of U.S. Pat. No. 4,142,571 are hereby incorporated by reference.

SUMMARY OF THE INVENTION

In accordance with the present invention, it has been found that, if a thin uniform layer of molten metal is mechanically supported on a contoured chill surface by the method and apparatus of my invention, it becomes possible to draw out contoured thin metal strips. That side of the strip which is cast in contact with the chill surface faithfully replicates even the finest contours of the chill surface. Protrusions and indentations of magnitude greater than about one tenth the thickness of the strip will also faithfully be reflected on the top side of the strip as mating protrusions or indentations.

Accordingly, the present invention provides an apparatus for making structurally defined (contoured) continuous metal strip from the melt. It comprises a movable chill body having a contoured chill surface, a slotted nozzle in communication with a reservoir for holding molten metal, and means for effecting expulsion of the molten metal from the reservoir through the nozzle onto the moving chill surface.

The movable chill body provides a contoured chill surface for deposition thereon of molten metal for solidification into a structurally defined metal strip, the surfaces of which replicate the contours of the chill surface. The chill body is adapted to provide longitudinal movement of the chill surface at velocities in the range of from about 100 to about 2000 meters per minute. The contours of the chill surface are provided by protruberances and/or indentations, which may be as high or as deep, as the case may be, as up to about 20 times the thickess of the strip being cast, provided that the walls of the protruberances and the indentation which are arranged in the direction of movement of the chill surface are not steeper than about 85°, measured with respect to the chill surface, and that the walls of those protruberances and/or indentations which are arranged in a direction transverse to the direction of movement of the chill surface are not steeper than about 65°, desirably not greater than about 60°, measured with respect to the chill surface. Contour walls arranged in direction intermediate to these extremes may have steepness ranging within the indicated angles, their maximum permissible steepness being a function of their direction. If the contours are represented by the protruberances and indentations are not higher or lower than about the thickness of the cast strip, the walls may be as steep as about 88°, more desirably as steep as about 85°, regardless of the direction of the wall. However, if their height exceed the thickness of the strip, and the walls are steeper than above indicated, there is danger that the metal strip will not replicate the wall, and that a discontinuity will develop in the strip. If the protrusions and/or indentations are higher or lower than the thickness of the strip, and the angle of the wall is less than about 2°, then a discontinuity in the strip will generally result, regardless of the direction of the wall. Otherwise, there is no limitation on the shape, form, design or structure of the contours.

The reservoir for holding molten metal includes heating means for maintaining the temperature of the metal above its melting point. The reservoir is in communication with the slotted nozzle for depositing molten metal onto the chill surface.

The slotted nozzle is located in close proximity to the chill surface. Its slot is arranged perpendicular to the direction of movement of the chill surface. The slot is defined by a pair of generally parallel lips, a first lip and a second lip, numbered in direction of movement of the chill surface. The slot must have a width, measured in direction of movement of the chill surface, of from about 0.3 to about 1 millimeter. There is no limitation on the length of the slot (measured perpendicular to the direction of movement of the chill surface) other than the practical consideration that the slot should not be longer than the width of the chill surface. The length of the slot determines the width of the strip or sheet being cast.

The width of the lips, measured in direction of movement of the chill surface, is a critical parameter. The first lip has a width at least equal to the width of the slot. The second lip has a width of from about 1.5 to about 3 times the width of the slot. The mean gap between the lips and the chill surface is at least about 0.1 times the width of the slot, but may be large enough to equal the width of the slot.

Means for effecting expulsion of the molten metal contained in the reservoir through the nozzle for deposition onto the moving chill surface includes pressurization of the reservoir, such as by an inert gas, or utilization of the hydrostatic head of molten metal if the level of metal in the reservoir is located in sufficiently elevated position. The invention further provides a method for forming a continuous, structurally defined metal strip by depositing molten metal onto the surface of a moving chill body having a contoured surface, as above described, which involves moving the surface of the chill body in a longitudinal direction at a constant, predetermined velocity within the range of from about 100 to about 2000 meters per minute past the orifice of a slotted nozzle defined by a pair of generally parallel lips located proximate to said surface such that the mean gap between the lips and the surface is from between about 0.03 to about 1 millimeter, and forcing a stream of molten metal through the orifice of the nozzle into contact with the contoured surface of the moving chill body to permit the metal to solidify thereon to form a continuous, structurally defined metal strip which replicates the surface contours of the chill body. The orifice of the slotted nozzle is being arranged generally perpendicular to the direction of movement of the surface of the chill body. Desirably, the molten metal is an alloy which, upon cooling from the melt and quenching at a rate of at least about $10^4$° C./sec. forms a glassy solid; it may also form a polycrystalline said metal.

The present invention further provides as a novel product a metal strip having a glassy (amorphous) structure, which is further characterized by having a thickness of from about 0.02 to about 0.14 millimeter, and being structurally defined in having matching protrusions and indentations on opposite sides thereof, said protrusions and indentations having a depth of from about 0.01 to about 20 times the thickness of the strip. If said protrusions and indentations are defined by walls higher than about the thickness of the strip, then these walls may not be steeper than about 85°, measured from the base surface of the strip, for walls arranged in longitudinal direction of the strip; and not steeper than about 65°, measured from the base surface of the strip, for walls arranged in transverse direction; and wall arranged in direction between the longitudinal and the transverse having walls of steepness not greater than from 65° to 85°, depending on their direction. For example, wall running at an angle of about 45° across the strip should have a steepness not greater than about 75°. If the protrusions and indentations are not higher than the thickness of the strip, then the walls defining them may be as steep as 88°, desirably not steeper than about 85°, measured from the base surface of the strip, regardless of their direction.

BRIEF DESCRIPTION OF THE DRAWINGS

FIG. 1 of the drawings provides a side view in partial cross-section illustrating formation of structurally defined strip from molten metal deposited onto a contoured moving chill surface from a nozzle having specific configuration and placement with relation to the chill surface, in accordance with the present invention. Here the chill surface is provided with transversely extending grooves, resulting in strip product having transversely extending corrugations.

FIGS. 2 and 3 of the drawings each provide a somewhat simplified perspective view of two embodiments of apparatus of the present invention in operation. In FIG. 2, formation of strip takes place on the contoured surface of a chill roll mounted to rotate around its longitudinal axis. In FIG. 3, formation of strip takes place on the contoured surface of an endless moving belt.

FIG. 4 provides a side view in cross section of a nozzle in its relation to the surface of the chill substrate for discussion of relative dimensions of slot width, lip dimensions, and mean gap between lip and chill surface.

DETAILED DESCRIPTION OF THE INVENTION AND THE PREFERRED EMBODIMENTS

Figure 5:
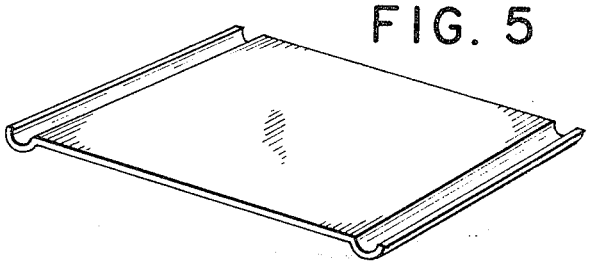
FIGS. 5, 6, 7, 8, 9*a* and 9*b* illustrate variously shaped structurally defined strip products of the present invention.

With reference to the drawings, FIG. 1 shows in partial cross section a side view illustrating the method of the present invention. As shown in FIG. 1, a chill body 1 having a contoured surface, here illustrated as a belt provided with transversely extending grooves, travels in the direction of the arrow in close proximity to a slotted nozzle defined by a first lip 3 and a second lip 4. Molten metal 2 is forced under pressure through the nozzle to be brought into contact with the moving surface of the chill body. As the metal is solidified in contact with the surface of the moving chill body, a solidification front, indicated by line 6, is formed. Above the solidification front a body of molten metal is maintained. The solidification front barely misses the end of second lip 4. First lip 3 supports the molten metal essentially by the pumping action of the melt which results from constant removal of solidified strip 5. The surface of the moving chill body 1 travels at a velocity within the range of from about 100 to about 2000 meters per minute. The rate of flow of molten metal equals the rate of removal of metal in the form of solid strip and is self-controlled. The rate of flow is pressure assisted, but controlled by the forming solidification front and the second lip 4 which mechanically supports the molten metal below it. Thus, the rate of flow of the molten metal is primarily controlled by the viscous flow between the second lip and the solid strip being formed, and is not primarily controlled by the slot width. In order to obtain a sufficiently high quench-rate to make an amorphous ribbon, the surface of the chill body must ordinarily move at a velocity of at least about 200 meters per minute. At lower velocities it is generally not possible to obtain quench rates, that is to say cooling rates at the solidification temperature, of at least $10^4$° C. per second, as is required in order to obtain glassy metal strips. Of course, lower velocities, as low as about 100 meters per minute, are usually operable, but result in polycrystalline strips. And, in any event, casting by my process of metal alloys which do not form glassy solids will result in polycrystalline strips, regardless of the velocity of travel of the chill surface. The velocity of movement of the chill surface should not be in excess of about 2000 meters per minute because as the speed of the substrate increases, the height of the solidification front is depressed due to decreased time available for solidification. This leads to formation of thin strip (thickness less than about 0.02 millimeter). Since the success of my process hinges on thorough wetting of the chill substrate by the molten metal, and since very thin layers of molten metal (e.g. thinner than about 0.02 millimeter) do not adequately wet the chill substrate, thin, porous strip is obtained which is not commercially acceptable. This is particularly pronounced if the casting operation is carried out other than in vacuum, since currents of the ambient gas, such as air, have substantial adverse influence on strip formation at higher substrate speeds. As a general proposition, it can be stated that an increase in chill surface velocity results in production of thinner strip and, conversely, that a reduction of that velocity results in thicker strip. Preferably, velocities range from about 300 to about 1500, more preferably from about 600 to about 1000 meters per minute.

Certain dimensions concerning the nozzle and its interrelationship with the chill surface are critical. They are explained with reference to FIG. 4 of the drawings. With reference to FIG. 4, width a of the slot of the slotted nozzle, which slot is arranged perpendicular to the direction of movement of the chill surface, should be from about 0.3 to about 1 millimeter, preferably from about 0.6 to about 0.9 millimeter. As previously stated, the width of the slot does not control the rate of flow of molten metal therethrough, but it might become a limiting factor if it is too narrow. While, to some extent that may be compensated for by employing higher pressures to force the molten metal at the required rate through the narrower slot, it is more convenient to provide a slot of sufficient width. If, on the other hand, the slot is too wide, say wider than about 1 millimeter, then at any given velocity of movement of the chill surface, the solidification front formed by the metal as it solidifies on the chill surface will be correspondingly thicker, resulting in a thicker strip which could not be cooled at a rate sufficient to obtain amorphous strip, if this were desired.

With further reference to FIG. 4, width b of second lip 4 is about 1.5 to about 3 times the width of the slot, preferably from about 2 to about 2.5 times the width of the slot. Optimum width can be determined by simple routine experimentation. If the second lip is too narrow, then it will fail to provide adequate support to the molten metal and only discontinuous strip is produced. If, on the other hand, the second lip is too wide solid-to-solid rubbing between the lip and the strip will result, leading to rapid failure of the nozzle. With further reference to FIG. 4, width c of first lip 3 must be at least about equal to the width of the slot, preferably at least about 1.5 times the width of the slot. If the first lip is too narrow, then the molten metal will tend to ooze out, the molten metal will not uniformly wet the chill surface, and no strip, or only irregular strip will be formed. Preferred dimensions of the first lip are from about 1.5 to about 3, more preferably from about 2 to about 2.5 times the width of the slot.

Still with reference to FIG. 4, the mean gap between the surface of the chill body 1 and first and second lips 3 and 4, respectively represented by d and e, may be from about 0.04 to about 1 millimeter, preferably from about 0.04 to about 0.25 millimeter, more preferably yet from about 0.08 to about 0.15 millimeter. In no event may the gap between the lips and the highest protrusions on the chill surface be less than about 0.03 millimeter. A mean gap in excess of about 1 millimeter would cause flow of the molten metal to be limited by slot width rather than by the lips. Strips produced under this condition are thicker, but are of non-uniform thickness. Moreover, they usually are insufficiently quenched and consequently have non-uniform properties. Such product lacks commercial acceptability. On the other hand, if the gap between the lips and the highest protrusions were less than about 0.03 millimeter, solid-to-solid contact between the solidification front and the nozzle would result when the slot width is in excess of about 0.3 millimeter, leading to rapid failure of the nozzle. Within the above parameters, the mean gap between the surface of the chill body and the lips may vary. It may for example, be larger on one side than the other, so that a strip of varying thickness across its width is obtained.

Within the above parameters, when, for example, the chill surface may be moved at a velocity of about 700 meters per minute, the width of the slot may be between about 0.5 to 0.8 millimeter. The second lip should be between about 1.5 to 2 times the width of the slot, and the first lip should be about 1 to 1.5 times the width of the slot. The metal in the reservoir should be pressurized to between about 0.5 to 2 psig. The gap between the second lip and the highest protrusions on the chill surface may be between about 0.05 to 0.2 millimeter.

With reference to FIG. 2 of the drawings, which provides a perspective view of apparatus for carrying out the method of the present invention, there is shown an annular chill roll 7 rotatably mounted around its longitudinal axis, having a chill surface provided with a plurality of spaced circumferential grooves, and reservoir 8 for holding molten metal equipped with induction heating coils 9. Reservoir 8 is in communication with slotted nozzle 10, which, as above described, is mounted in close proximity to the surface of annular chill roll 7. Annular chill roll 7 may optionally be provided with cooling means (not shown), as means for circulating a cooling liquid, such as water, through its interior. Reservoir 8 is further equipped with means (not shown) for pressurizing the molten metal contained therein to effect expulsion thereof through nozzle 10. In operation, molten metal maintained under pressure in reservoir 8 is ejected through nozzle 10 onto the surface of the rotating chill roll 1, whereon it immediately solidifies to form longitudinally corrugated strip 11. Strip 11 is separated from the chill roll by means of a blast of air from nozzle 12, and is flung away therefrom to be collected by a suitable collection device (not shown).

The embodiment illustrated by FIG. 3 of the drawings employs as chill body an endless belt 13 which is placed over rolls 14 and **14*a* which are caused to rotate by external means (not shown). The chill surface provided by the belt is covered with diagonally running crossed protrusions, providing a waffled surface. Molten metal is provided from reservoir 15, equipped with means for pressurizing the molten metal therein (not shown). Molten metal in reservoir 15 is heated by electrical induction heating coil 16. Reservoir 15 is in communication with nozzle 17 equipped with a slotted orifice. In operation, belt 11 is moved at a longitudinal velocity of at least about 600 meters per minute. Molten metal from reservoir 15 is pressurized to force it through nozzle 17 into contact with belt 13, whereon it is solidified into a solid strip 18 which is separated from belt 13 by means not shown. Strip 18** is of substantially uniform thickness throughout, and carries a diagonally running waffle pattern.

The surface of the chill body which provides the actual chill surface can be any metal having relatively high thermal conductivity, such as copper. This requirement is particularly applicable if it is desired to make amorphous or metastable strips. Preferred materials of construction include beryllium copper and oxygen free copper. If desired, the chill surface may be highly polished or may be provided with a highly uniform surface, such as chrome plate, to obtain filament having smooth surface characteristics. The contours, that is to say the protrusions and/or indentations can be machined into the chill surface employing conventional engraving or etching procedures, or any other suitable procedures. Desirably, however, the surface of the indentations and protrusions, and the walls by which they are outlined, as well as the base surface of the chill surface, are polished to insure efficient disengagement of the strip from the chill surface.

In short run operation it will not ordinarily be necessary to provide cooling for the chill body provided it has relatively large mass so that it can act as a heat sink and absorb considerable amount of heat. However, for longer runs, and especially if the chill body is a belt which has relatively little mass, cooling of the chill body is desirably provided. This may be conveniently accomplished by contacting it with cooling media which may be liquids or gases. If the chill body is a chill roll, water or other liquid cooling media may be circulated through it, or air or other gases may be blown over it. Alternatively, evaporative cooling may be employed, as by externally contacting the chill body with water or any other liquid medium which through evaporation provides cooling.

The slotted nozzle employed for depositing molten metal onto the chill surface may be constructed of any suitable material. Desirably, a material is chosen which is not wetted by the molten metal. A convenient material of construction is fused silica, which may be blown into desired shape and then be provided with a slotted orifice by machining. For the sake of convenience, the reservoir and the nozzle may be shaped from a single piece of material. The lips forming the nozzle are essentially flat, although, if the protrusions and/or indentations are running longitudinally in the direction of movement of the chill surface, the lips may be contoured to follow the contour of the chill surface.

The molten metal which is to be formed into a strip by means of the method of the present invention is heated, preferably in an inert atmosphere, to temperature approximately 50° to 100° C. above its melting point or higher. A slight vacuum may be applied to the vessel holding the molten metal to prevent premature flow of the molten metal through the nozzle. Ejection of the molten metal through the nozzle is required and may be effected by the pressure of the static head of the molten metal in the reservoir, or preferably by pressurizing the reservoir to pressure in the order of, say 0.5 to 1 psig, or until the molten metal is ejected. If pressures are excessive, more molten metal may be forced through the slot than can be carried away by the chill surface resulting in uncontrolled pressure flow. In a severe case, splattering of the molten metal may result. In a less severe case, strip having a ragged, irregular edge and of irregular thickness will be formed. Correctness of pressure can be judged by the appearance of the strip; if it is uniformly dimensioned, correct pressure is applied. Correctness of pressure can be judged during the casting operation by the appearance of the strip in the vicinity of the second lip.

Metals which can be formed into polycrystalline strip directly from the melt by my process include aluminum, tin, copper, iron, steel, stainless steel and the like.

Metal alloys which, upon rapid cooling from the melt, form solid glassy structures are preferred. These are well known to those skilled in the art. Exemplary such alloys are disclosed in U.S. Pat. Nos. 3,427,154 and 3,981,722, as well as others.

The process of the present invention may be carried out in air, in a partial or high vacuum, or in any desired atmosphere which may be provided by an inert gas such as nitrogen, argon, helium, and the like. When it is conducted in vacuum, it is desirably conducted under vacuum within the range of from about 100 up to about 3000 microns.

Figure 6:
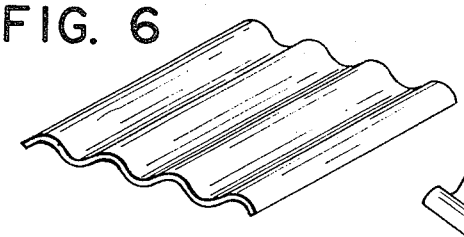
Figure 7:
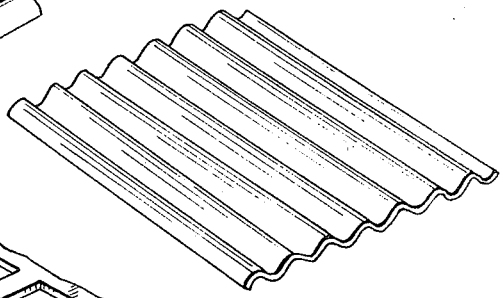
Figure 8:
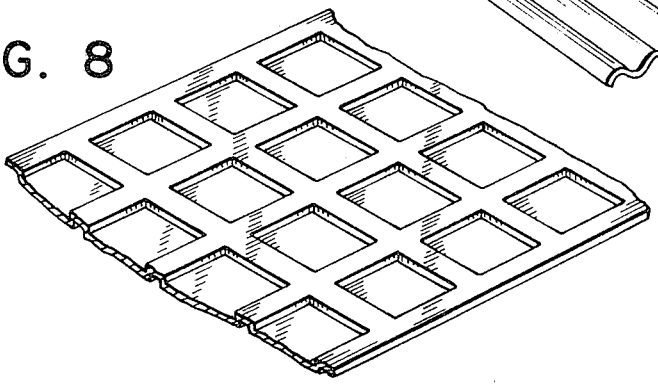
Figure 9A:
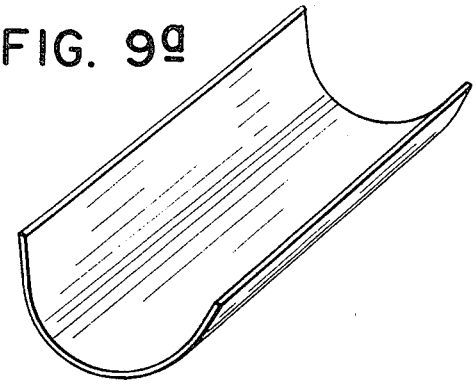
Figure 9B:
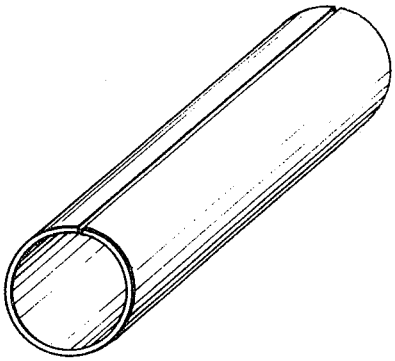

The product of the present invention is a strip of metal with a glassy (amorphous) molecular structure, having a thickness of from about 0.02 to about 0.14 millimeter, preferably from about 0.03 to about 0.1 millimeter, more preferably yet from about 0.05 to about 0.08 millimeter, having matching protrusions and indentations on opposite sides, said protrusions and indentations having a depth of from about 0.1 to about 20 times, preferably of from about 0.5 to about 10 times the thickness of the strip. If said protrusions and indentations are defined by walls which are higher than about the thickness of the strip, then these walls may not be steeper than about 85°, preferably not steeper than about 80°, measured from the base surface of the strip, for walls arranged in longitudinal direction of the strip; and not steeper than about 65°, preferably not steeper than about 60°, measured from the base surface of the strip, for walls arranged transversely of the strip; and walls arranged in direction intermediate of the longitudinal and the transverse having walls of steepness not greater than from about 65° to 85°, preferably not greater than from about 60° to 80°, depending on their direction if the protrusions and indentions are defined by walls not higher than about the thickness of the strip, then the walls defining them may be as steep as about 88°, desirably not steeper than about 85°, measured from the base of the strip, regardless of their direction. The contours provided by the protrusions and indentations may be of regular or irregular shape, there being no structural limitations, other than the above-described limitations concerning depth and wall angle. Particularly desirable strip shapes include those having marginal grooves for reinforcement of the marginal portions of the strip, as shown in FIG. 5; those having longitudinal or transverse corrugations, as shown in FIGS. 6 and 7, respectively, which stiffen the strip in the direction of the corrugation; and waffled strip, as illustrated in FIG. 8, which has improved stiffness in all directions. The contoured strip of the present invention is particularly suited for use as reinforcement material, particularly in composite structures. It is also possible to cast U-shaped sections, as illustrated in FIG. 9*a*, which can subsequently be formed into a tubular structure, as shown in FIG. 9*b*, as by drawing through a suitably shaped die, e.g. a circular die.

The following example illustrates the present invention and set forth the best mode presently contemplated for its practice.

EXAMPLE

Apparatus employed is similar to that depicted in FIG. 2. The chill roll employed has a diameter of 16 inches and it is 5 inches wide. It is provided with V-shaped circumferential grooves, each groove being 0.2 millimeter deep and 0.4 millimeter wide at the roll surface. The chill roll is rotated at a speed of about 700 rpm, corresponding to a linear velocity of the peripheral surface of the chill roll of about 895 meters per minute. A nozzle having a slotted orifice of 0.9 millimeter width and 51 millimeter length defined by a first lip of 1.8 millimeters width and a second lip of 2.4 millimeters width (lips numbered in direction of rotation of the chill roll) is mounted perpendicular to the direction of movement of the peripheral surface of the chill roll, such that the gap between the second lip and the surface of the chill roll is 0.05 millimeter, and the gap between the first lip and the surface of the chill roll is 0.06 millimeter. Metal having composition $Fe_{40}Ni_{40}P_{14}B_6$ (atomic percent) with a melting point of about 950° C. is employed. It is supplied to the nozzle from a pressurized crucible wherein it is maintained under pressure of about 0.7 psig at temperature of 1000° C. Pressure is supplied by means of an argon blanket. The molten metal is expelled through the slotted orifice at the rate of 14 kilograms per minute. It solidifies on the surface of the chill roll into a strip of 0.05 millimeter thickness throughout, having width of 5 centimeters. The circumferential grooves of the chill roll are faithfully reproduced on the strip, as V-shaped protrusions on that side of the strip which was cast in contact with the chill roll, and matching indentations on the opposite side of the strip. Upon examination using X-ray diffractometry, the strip is found to be amorphous in structure.

Since various changes and modifications may be made in the invention without departing from the spirit and essential characteristics thereof, it is intended that all matter contained in the above description be interpreted as illustrative only, the invention being limited by only the scope of the appended claims.

I claim:

1. A strip of glassy metal having a thickness of from about 0.02 to about 0.14 mm, and being structurally defined in having substantially corresponding protrusions and indentations on opposite surfaces, said protrusions and indentations being defined by walls having a height and depth of from about 0.1 to about 20 times the thickness of the strip, with the provisos that (a) walls defining protrusions and indentations of height and depth respectively of less than the thickness of the strip are not steeper than about 88°, measured with respect to the base surface of the strip; and (b) walls defining protrusions and indentations of height and depth greater than the thickness of the strip are not steeper than (i) about 65°, measured with respect to the base surface of the strip, when arranged in direction transverse to the length of the strip, (ii) about 85°, measured with respect to the base surface of the strip, when arranged in longitudinal direction of the strip, and (iii) between 65° and 85°, measured with respect to the base surface of the strip, when arranged in direction between the transverse and the longitudinal.

2. Strip according to claim 1 wherein the walls defining said protrusions and indentations have a height and depth respectively of less than the thickness of the strip, and wherein said walls are not steeper than about 88°, measured with respect to the base surface of the strip.

3. Strip according to claim 1 wherein the walls defining said protrusions and indentations have a height and depth greater than the thickness of the strip, and wherein said walls are not steeper than about 65°, measured with respect to the base surface of the strip when arranged in direction transverse to the length of the strip; not steeper than about 85°, measured with respect to the base surface of the strip when arranged lengthwise of the strip, and walls arranged in intermediate direction having steepness therebetween.

4. A strip according to claim 1 provided with corrugations.

5. A strip according to claim 1 having one or more longitudinally extending corrugations.

* * * * *